US011554283B2

(12) United States Patent
Hsu

(10) Patent No.: US 11,554,283 B2
(45) Date of Patent: Jan. 17, 2023

(54) EXERCISE MACHINE AND DUAL RESISTANCE STRUCTURE COMBINING WIND RESISTANCE AND MAGNETIC RESISTANCE THEREOF

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 17/308,201

(22) Filed: May 5, 2021

(65) Prior Publication Data

US 2021/0346748 A1 Nov. 11, 2021

(30) Foreign Application Priority Data

May 6, 2020 (TW) ..... 109205448

(51) Int. Cl.
*A63B 21/00* (2006.01)
*A63B 21/008* (2006.01)
*A63B 21/22* (2006.01)

(52) U.S. Cl.
CPC .... *A63B 21/00192* (2013.01); *A63B 21/0088* (2013.01); *A63B 21/22* (2013.01)

(58) Field of Classification Search
CPC ..... A63B 21/00192; A63B 21/0088; A63B 21/22; A63B 21/00069; A63B 22/0605; A63B 22/06; A63B 22/0664; A63B 22/0076
See application file for complete search history.

(56) References Cited

U.S. PATENT DOCUMENTS

| | | | | |
|---|---|---|---|---|
| 5,051,638 | A * | 9/1991 | Pyles | A63B 21/0051 310/105 |
| 7,955,227 | B2 * | 6/2011 | Chen | A63B 69/16 482/61 |
| 9,199,115 | B2 * | 12/2015 | Yim | A63B 22/001 |
| 9,415,252 | B2 * | 8/2016 | Delle Donne | A63B 22/0605 |
| 9,945,383 | B2 * | 4/2018 | Wang | F04D 17/16 |
| 10,112,067 | B2 * | 10/2018 | Golesh | A63B 21/015 |
| 10,155,132 | B2 * | 12/2018 | Jones | A63B 21/154 |
| 10,226,657 | B2 * | 3/2019 | Smith | A63B 22/0664 |

(Continued)

*Primary Examiner* — Joshua Lee
(74) *Attorney, Agent, or Firm* — Rosenberg, Klein & Lee

(57) ABSTRACT

An exercise machine and a dual resistance structure combining wind resistance and magnetic resistance are disclosed. The dual resistance structure combining wind resistance and magnetic resistance includes a rotating shaft, a wind resistance unit, and a magnetic resistance unit. The wind resistance unit is disposed on the rotating shaft, and includes blades arranged annularly. Each blade has a notch recessed in an axial direction of the rotating shaft. The magnetic resistance unit includes a magnetic resistance member and a magnetic resistance wheel. The magnetic resistance wheel is disposed on the rotating shaft. The notch of each blade faces the magnetic resistance wheel to form a moving space between the magnetic resistance wheel and the notch. When the magnetic resistance member is moved relative to the magnetic resistance wheel along a radial direction of the magnetic resistance wheel, part of the magnetic resistance member is movable in the moving space.

8 Claims, 8 Drawing Sheets

(56) References Cited

U.S. PATENT DOCUMENTS

| | | | | |
|---|---|---|---|---|
| 10,300,321 | B2 * | 5/2019 | Hsu | F04D 29/624 |
| 10,493,311 | B2 * | 12/2019 | Chou | A63B 22/0605 |
| 10,639,512 | B2 * | 5/2020 | Huang | A63B 21/015 |
| 10,814,154 | B2 * | 10/2020 | Wang | A63B 21/00069 |
| 2007/0179025 | A1 * | 8/2007 | Tsai | A63B 21/0088 482/57 |
| 2016/0153852 | A1 * | 6/2016 | Wu | A63B 21/00069 73/862.332 |
| 2018/0256932 | A1 * | 9/2018 | Hsu | A63B 23/03525 |
| 2020/0197739 | A1 * | 6/2020 | Hsieh | A63B 69/06 |

* cited by examiner

EXERCISE MACHINE AND DUAL RESISTANCE STRUCTURE COMBINING WIND RESISTANCE AND MAGNETIC RESISTANCE THEREOF

FIELD OF THE INVENTION

The present invention relates to an exercise machine and a dual resistance structure combining wind resistance and magnetic resistance thereof. Through a moving space formed between a notch of a blade and a magnetic resistance wheel, a magnetic resistance member is movable in the moving space along a radial direction of the magnetic resistance wheel to adjust a magnetic resistance of the magnetic resistance wheel.

BACKGROUND OF THE INVENTION

Taiwan Patent Publication No. I636810 discloses a magnetic resistance adjustment device of a wind resistance exercise bike. The exercise bike is provided with a traction cable. The exercise bike comprises a resistance wheel, a magnetic resistance ring, a fixing member, and a displacement member. The resistance wheel has blades for generating wind resistance and is installed on the exercise bike. The resistance wheel has a wheel body and a wheel shaft. The wheel shaft is installed on the wheel body. The magnetic resistance ring is installed on the resistance wheel. The fixing member is installed on the wheel shaft. A positioning bolt is provided on the fixing member. The direction in which the fixing member extends to the magnetic resistance ring is defined as a displacement direction. The displacement member has a displacement hole, a fixing portion, and a magnetic resistance portion. The displacement hole allows the positioning bolt to be inserted therein, so that the displacement member can be displaced back and forth in the displacement direction for the magnetic resistance portion to be moved toward or away from the magnetic resistance ring. The fixing portion is driven by and connected with the traction cable.

In the above-mentioned patent, although the combination of the wind resistance unit and the magnetic resistance unit enhances the exercise effect of the sports device, the wind resistance unit is installed and fixed on the resistance wheel of the magnetic resistance unit. Due to the space limitation of the device, the blades of the wind resistance unit are too short, and the wind resistance generated by the wind resistance unit is too small.

Taiwan Patent Publication No. I651114 discloses a resistance adjustment device combining wind resistance and magnetic resistance. The resistance adjustment device is installed on a support and includes a rotating unit, a magnetic resistance unit and a wind resistance unit. The rotating unit includes a mandrel, a coupling block, and a magnetic rotating wheel. The mandrel is rotatably installed on the support. The coupling block is fixed to the mandrel. The magnetic rotating wheel is detachably connected to the coupling block. The magnetic resistance unit is movably disposed on the support and includes an adjustment seat and a plurality of magnetic members. The adjustment seat is movably disposed on the support. The magnetic member is arranged on the adjustment seat. The wind resistance unit is detachably disposed on the outer side of the magnetic rotating wheel.

In the above-mentioned patent, although the combination of the wind resistance unit and the magnetic resistance unit enhances the exercise effect of the sports device, the wind resistance unit is installed on the magnetic rotating wheel. In order to avoid hindering the adjustment seat from carrying the magnetic member toward the magnetic rotating wheel to adjust the magnetic resistance, the magnetic rotating wheel needs to be larger than the wind resistance unit. As a result, the length of the blades of the wind resistance unit is limited, and the wind resistance generated is too small.

Taiwan Utility Model Publication No. M511345 discloses a fan damping device with an adjustable magnetic resistance. The fan damping device comprises a support frame, a fan rotating wheel, a magnetic induction ring, and a magnetic control unit. The fan rotating wheel is rotatably disposed on the support frame. The fan rotating wheel includes a central disc portion and a plurality of extending necks. One end of each extending neck is integrally formed with the periphery of the central disc portion, and the other end of each extending neck is twisted to form a blade. The magnetic induction ring is fixedly disposed on the central disc portion. The magnetic induction ring is made of a material that can be attracted by magnetic attraction. The magnetic control unit includes a path limit member and a magnetic control assembly. The path limit member is fixedly disposed on the support frame. The path limit member defines an arc-shaped limit opening. The magnetic control assembly includes a magnet seat and a plurality of magnets. One end of the magnet seat is a pivot end, and the other end is an outer end. The magnet seat has a first surface and an opposing second surface. A controlled portion is provided between the two ends of the magnet seat and extends in a direction away from the second surface. The first surface of the magnet seat faces the path limit member, and the pivot end is pivotally coupled to the path limit member. The magnets are arranged on the second surface of the outer end of the magnet seat.

In the above-mentioned patent, although the combination of the wind resistance unit and the magnetic resistance unit enhances the exercise effect on the sports device, the magnetic control assembly is moved toward the magnetic induction ring from the side to adjust the resistance. The unilateral magnetic resistance has a limited effect in adjusting the magnetic resistance. Besides, the magnets of the magnetic control assembly act on the magnetic induction ring on one side, so that the magnetic induction ring is stressed on one side, causing the center disc portion to be deformed.

SUMMARY OF THE INVENTION

According to one aspect of the present invention, a dual resistance structure combining wind resistance and magnetic resistance is provided. The dual resistance structure combining wind resistance and magnetic resistance comprises a rotating shaft, a wind resistance unit, and a magnetic resistance unit. The wind resistance unit is disposed on the rotating shaft. The wind resistance unit includes a plurality of blades arranged annularly. Each of the blades has a notch recessed in an axial direction of the rotating shaft. The magnetic resistance unit includes a magnetic resistance member and a magnetic resistance wheel. The magnetic resistance wheel is disposed on the rotating shaft. The notch of each of the blades faces the magnetic resistance wheel to form a moving space between the magnetic resistance wheel and the notch. When the magnetic resistance member is moved relative to the magnetic resistance wheel along a radial direction of the magnetic resistance wheel, part of the magnetic resistance member is movable in the moving space.

According to another aspect of the present invention, an exercise machine having a dual resistance structure combining wind resistance and magnetic resistance is provided. The exercise machine comprises an exercise machine body, a rotating shaft, a wind resistance unit, and a magnetic resistance unit.

The exercise machine body has a control unit and an operating portion. The rotating shaft is disposed on the exercise machine body and connected with the operating portion. The wind resistance unit is disposed on the rotating shaft. The wind resistance unit includes a plurality of blades arranged annularly. Each of the blades has a notch recessed in an axial direction of the rotating shaft. The magnetic resistance unit includes a magnetic resistance member and a magnetic resistance wheel. The magnetic resistance wheel is disposed on the rotating shaft. The magnetic resistance member is pivotally connected to the exercise machine body and connected with the control unit. The notch of each of the blades faces the magnetic resistance wheel to form a moving space between the magnetic resistance wheel and the notch. When the magnetic resistance member is moved relative to the magnetic resistance wheel along a radial direction of the magnetic resistance wheel, part of the magnetic resistance member is movable in the moving space.

Preferably, the magnetic resistance member is located on a periphery of the magnetic resistance wheel. The magnetic resistance member includes a first portion, an opposing second portion, and a connecting portion connecting the first portion and the second portion. A groove is defined among the first portion, the second portion and the connecting portion. The first portion or/and the second portion is provided with a magnetic member. The second portion and the connecting portion are movable in the moving space when the groove is selectively moved in or out of the magnetic resistance wheel.

Preferably, the wind resistance unit includes a turning disc. The turning disc has a diameter less than that of the magnetic resistance wheel. The turning disc is fixed to the rotating shaft. The blades are fixed to the turning disc. The blades extend in the radial direction beyond the magnetic resistance wheel.

Preferably, a periphery of the turning disc has a plurality of engaging grooves each recessed in the radial direction. Each of the blades has a coupling end. The coupling end has an L-shaped notch and a fixing piece extending from a periphery of the L-shaped notch. The L-shaped notch and the fixing piece are formed by stamping. Each of the blades further has an engaging block extending in the radial direction. The fixing piece of each of the blades is locked to the turning disc. The engaging block is engaged in a corresponding one of the engaging grooves so that the each of the blades is fixed to the turning disc.

According to the above technical features, the following effects can be achieved:

1. The magnetic resistance member includes a first portion, a second portion, and a connecting portion. A groove is defined among the first portion, the second portion and the connecting portion. The first portion or/and the second portion is provided with a magnetic member. Each of the blades has a notch recessed in an axial direction of the rotating shaft. A moving space is formed between the magnetic resistance wheel and the notch of each of the blades. The second portion and the connecting portion of the magnetic resistance member are freely movable in the moving space when the magnetic resistance member is selectively moved in a radial direction of the magnetic resistance wheel. In this way, because the magnetic resistance unit and the wind resistance unit are juxtaposed on the rotating shaft, the first portion and the second portion of the magnetic resistance member can still be approached or separated from both sides of the magnetic resistance wheel simultaneously, completely unaffected by the wind resistance unit. If both the first portion and the second portion of the magnetic resistance member are provided with magnetic members, the symmetrical magnetic members enables the magnetic resistance wheel to obtain a balanced magnetic resistance, and the magnetic resistance wheel is less likely to be deformed.

2. The blades of the present invention may be locked to the turning disc in advance and then assembled on the rotating shaft. The diameter of the rotating disc is less than the diameter of the magnetic resistance wheel to maintain a sufficient length of the blades, so that the resistance of the wind resistance unit when rotated is greater, so as to achieve an exercise effect through wind resistance.

3. In this invention, the turning disc has an engaging groove. Each of the blades has a coupling end. The coupling end has a fixing piece extending radially. The coupling end is axially engaged in the engaging groove. The blade is fixed in both radial and axial directions, so that the blade is not easy to fall when the wind resistance unit is rotated.

DESCRIPTION OF THE PREFERRED EMBODIMENTS

Embodiments of the present invention will now be described, by way of example only, with reference to the accompanying drawings.

Figure 1:
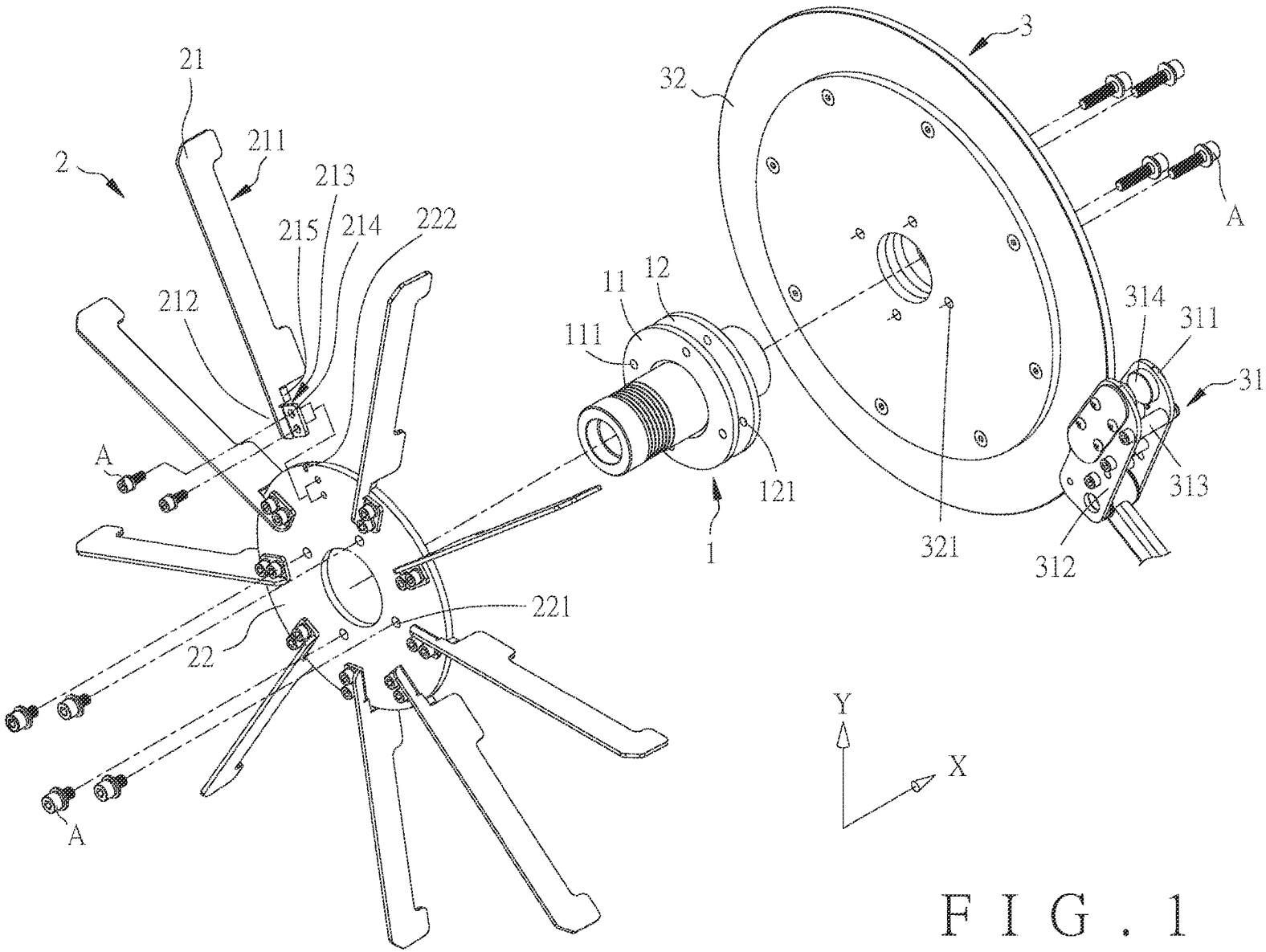
FIG. 1 is an exploded view of the dual resistance structure combining wind resistance and magnetic resistance of the present invention.
Figure 2:
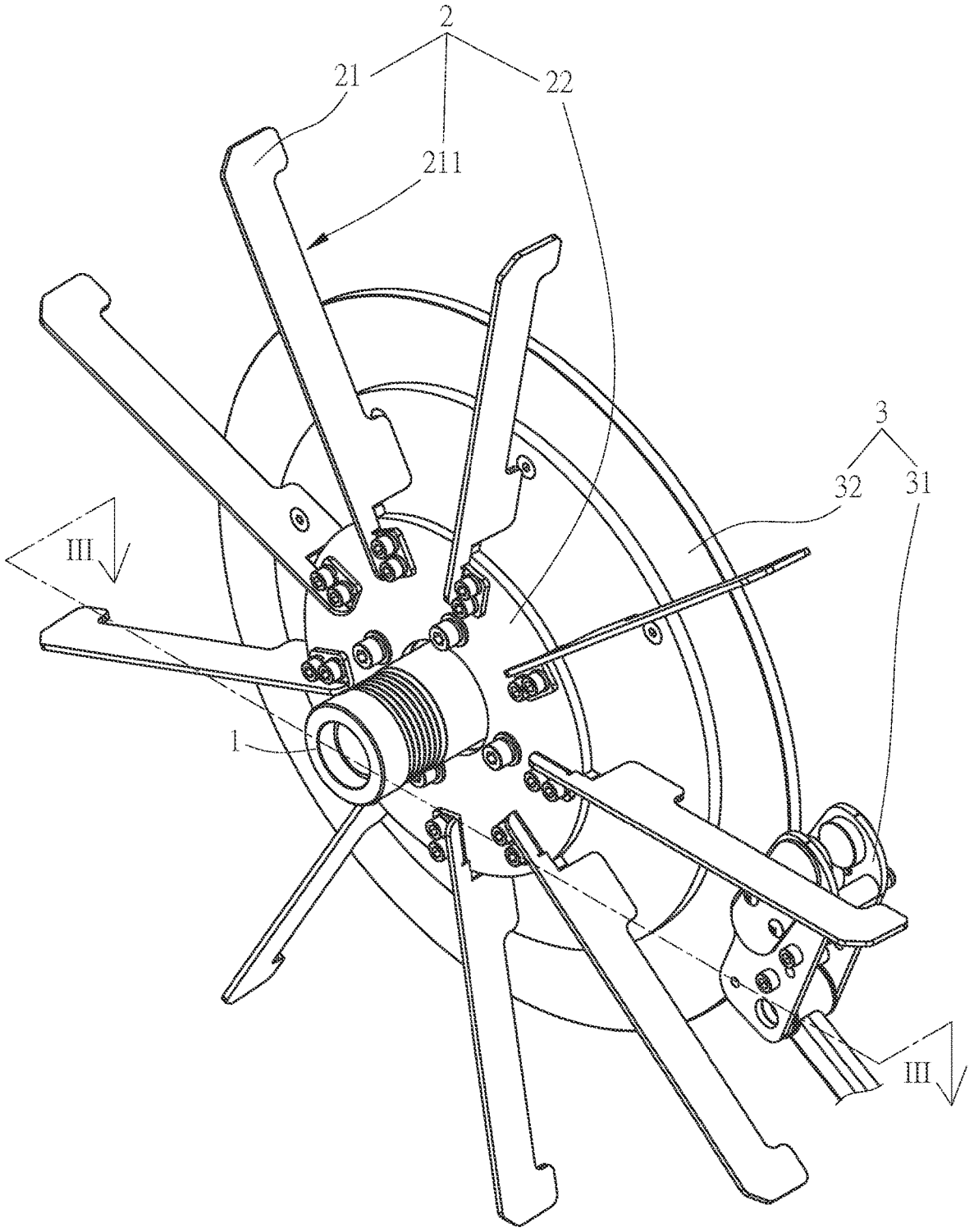
FIG. 2 is a perspective view of the dual resistance structure combining wind resistance and magnetic resistance of the present invention.
Figure 3:
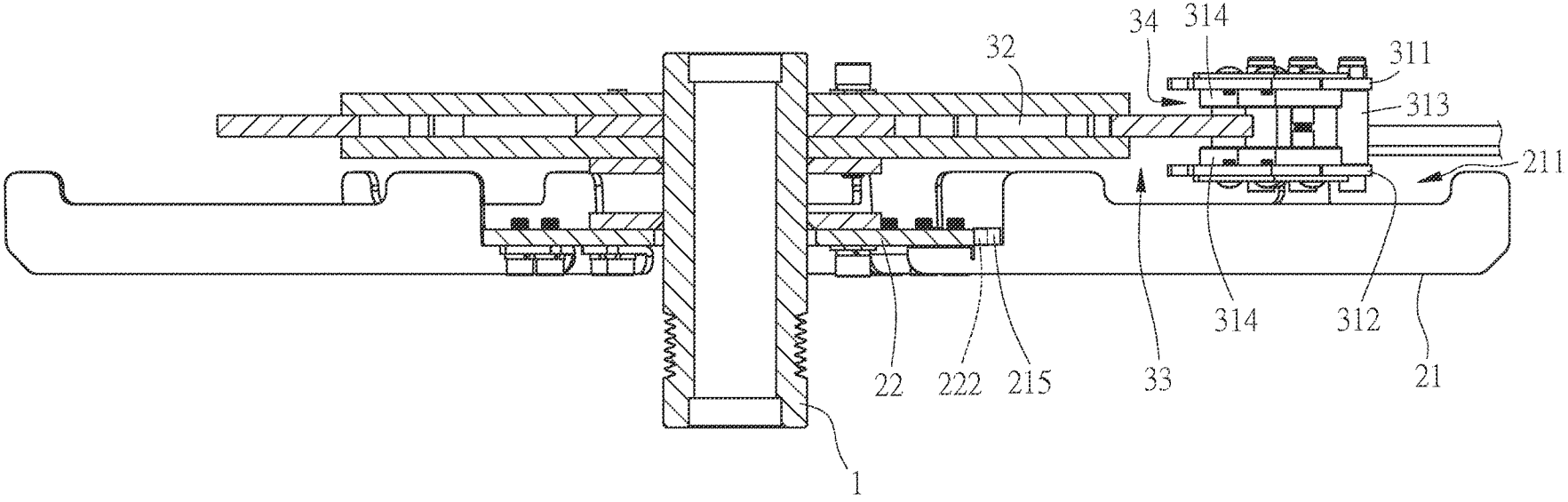
FIG. 3 is a cross-sectional view of the dual resistance structure combining wind resistance and magnetic resistance of the present invention, illustrating that part of the magnetic resistance member is located in the moving space so that part of the magnetic member corresponds to the magnetic reluctance wheel.

As shown in FIG. 1 through FIG. 3, the present invention discloses a dual resistance structure combining wind resistance and magnetic resistance comprises a rotating shaft 1, a wind resistance unit 2, a magnetic resistance unit 3, and a plurality of screws A. The rotating shaft 1 rotates about an axial direction X. The rotating shaft 1 has a first connecting portion 11 and a second connecting portion 12. The first connecting portion 11 is formed with four first perforations 111. The second connecting portion 12 is formed with four second perforations 121. The wind resistance unit 2 includes a turning disc 22. The turning disc 22 is formed with four third perforations 221. The third perforations 221 correspond to the respective first perforations 111. The screws A are screwed into the third perforations 221 and the first perforations 111 to lock the turning disc 22 to the first connecting portion 11. The periphery of the turning disc 22 has a plurality of engaging grooves 222 each recessed in a radial direction Y. The wind resistance unit 2 further includes a plurality of blades 21 arranged annularly. Each of the blades 21 has a notch 211 recessed in the axial direction X of the rotating shaft 1. The blades 21 extend in the radial direction Y. Each of the blades 21 has a coupling end 212. The coupling end 212 has an L-shaped notch 213 and a fixing piece 214 extending from the periphery of the L-shaped notch 213. The L-shaped notch 213 and the fixing piece 214 are formed by stamping. Each of the blades 21 further has an engaging block 215 extending in the radial direction Y. The fixing piece 214 of each of the blades 21 is connected to the turning disc 22 by the screw A, and the engaging block 215 is engaged in the corresponding engaging groove 222, so that each of the blades 21 is fixed to the turning disc 22. The magnetic resistance unit 3 includes a magnetic resistance member 31 and a magnetic resistance wheel 32. The magnetic resistance wheel 32 is formed with four fourth perforations 321. The fourth perforations 321 correspond to the respective second perforations 121. The screws A are screwed into the fourth perforations 321 and the second perforations 121 to lock the magnetic resistance wheel 32 to the second connecting portion 12. All the blades 21 extend in the radial direction Y beyond the magnetic resistance wheel 32. The diameter of the turning disc 22 is less than the diameter of the magnetic resistance wheel 32.

The notch 211 of each of the blades 21 faces the magnetic resistance wheel 32 to form a moving space 33 between the magnetic resistance wheel 32 and the notch 211. The magnetic resistance member 31 is movable relative to the magnetic resistance wheel 32 along the radial direction Y of the magnetic resistance wheel 32. The magnetic resistance member 31 includes a first portion 311, an opposing second portion 312, and a connecting portion 313 connecting the first portion 311 and the second portion 312. A groove 34 is defined among the first portion 311, the second portion 312 and the connecting portion 313. The first portion 311 or/and the second portion 312 is provided with a magnetic member 314. In this embodiment, three magnetic members 314 are provided on each of the first portion 311 and the second portion 312. The magnetic members 314 are permanent magnets. The magnetic members 314 of the first portion 311 and the second portion 312 correspond to each other. The magnetic resistance member 31 can be moved in the radial direction Y of the magnetic resistance wheel 32, so that the first portion 311 or the second portion 312 is selectively moved in or away from the magnetic resistance wheel 32, thereby controlling the magnetic resistance of the magnetic resistance wheel 32. When the magnetic resistance member 31 is moved relative to the magnetic resistance wheel 32, the second portion 312 and the connecting portion 313 are moved in the moving space 33 freely.

Figure 4:
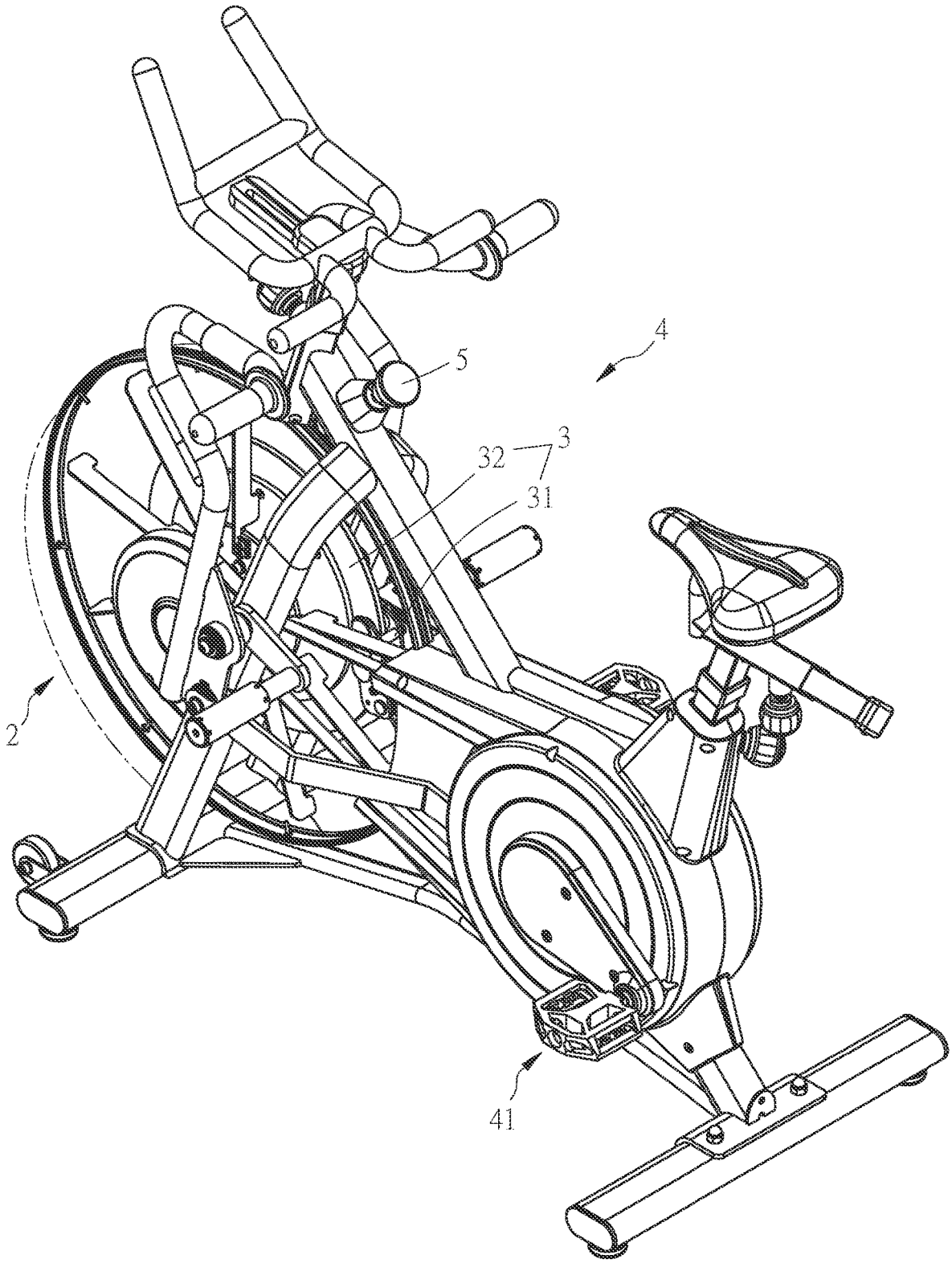
FIG. 4 is a perspective view of the exercise machine having the dual resistance structure combining wind resistance and magnetic resistance of the present invention.

As shown in FIG. 4, the present invention further discloses an exercise machine. The dual resistance structure combining wind resistance with magnetic resistance is mounted on an exercise machine body 4. The exercise machine further includes a control unit 5 and an operating portion 41. The control unit 5 is fixed on the exercise machine body 4 and is configured to operate the magnetic resistance member 31. The magnetic resistance member 31 is pivotally connected to the exercise machine body 4. The exercise machine body 4 takes an exercise bike as an example. In this embodiment, the operating portion 41 is two pedals. The user continuously steps on the operating portion 41 to drive the rotating shaft 1 (as shown in FIG. 1) to rotate. The control unit 5 is configured to control the magnetic resistance member 31 to approach or move away from the magnetic resistance wheel 32. The operating portion 41 is configured to operate the wind resistance unit 2 and the magnetic resistance wheel 32 to rotate. The control unit 5 and the operating portion 41 can be operated in the same manner as the conventional exercise machine, which will not be repeated hereinafter.

Figure 5:
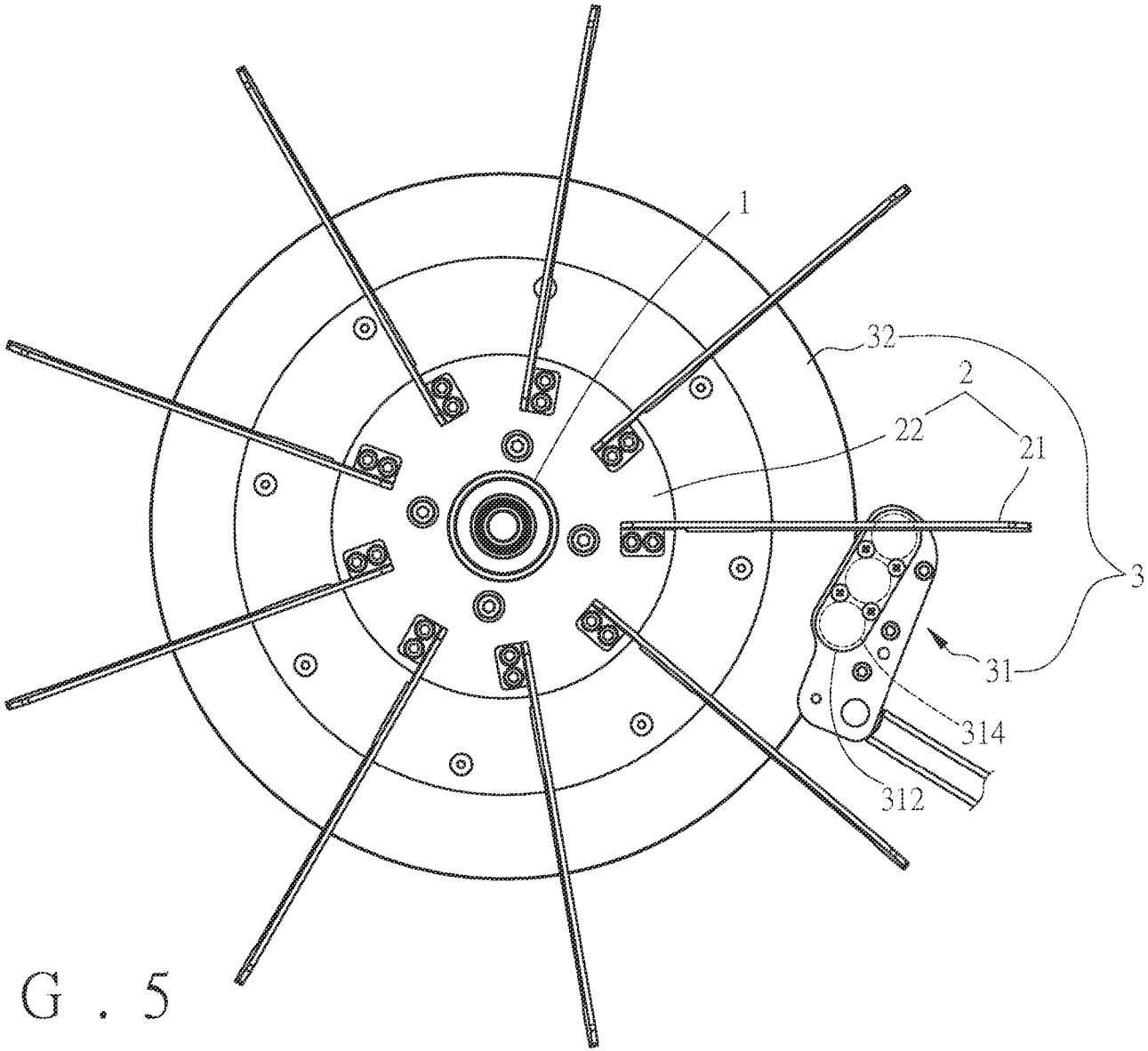
FIG. 5 is a side view of the dual resistance structure combining wind resistance and magnetic resistance of the present invention, illustrating that part of the magnetic resistance member is located in the moving space so that part of the magnetic member corresponds to the magnetic resistance wheel.

As to the wind resistance structure, please refer to FIG. 3 and FIG. 5. When the rotating shaft 1 rotates, the rotating disc 22 and the magnetic resistance wheel 32 are driven to rotate, and the blades 21 on the rotating disc 22 are rotated to generate a wind resistance. The magnitude of the wind resistance will be affected by the size of the blades 21. The blades 21 extend outwardly beyond the magnetic resistance wheel 32. Because the length of the blades 21 is long, the resistance generated by rotation of the wind resistance unit 2 is large, thereby providing an exercising effect through the wind resistance.

As to the magnetic resistance structure, please refer to FIG. 3, FIG. 4, FIG. 5 and FIG. 5A. The control unit 5 pulls a driving block 7 through a cable 6. One end of the cable 6 is connected to the driving block 7, and the other end of the cable 6 is connected to the control unit 5. (The control unit 5 is not shown in FIG. 5A). The driving block 7 is fixed to a shaft member 8. The shaft member 8 is rotatably pivotally connected to the exercise machine body 4. The magnetic resistance member 31 is also fixed to the shaft member 8, so that the magnetic resistance member 31 and the driving block 7 are rotated synchronously with the shaft member 8 as the axis. Furthermore, a spring 9 is disposed between the exercise machine body 4 and the magnetic resistance member 31 to provide the magnetic resistance member 31 a return elastic force. Through the cable 6 to pull the driving block 7, the magnetic resistance member 31 and the driving block 7 are moved synchronously to approach magnetic resistance wheel 32 with the shaft member 8 as the axis, and the spring 9 is stretched. If the cable 6 is released, the spring 9 will pull the magnetic resistance member 31 and the driving block 7 away from the magnetic resistance wheel 32 synchronously. When the magnetic resistance member 31 of the magnetic resistance unit 3 is moved toward the magnetic resistance wheel 32, the second portion 312 and the connecting portion 313 of the magnetic resistance member 31 moves freely in the moving space 33. In the state shown FIG. 5, only part of the magnetic member 314 is moved into the magnetic resistance wheel 32. At this time, the magnetic resistance of the magnetic resistance wheel 32 is smaller.

Figure 5A:
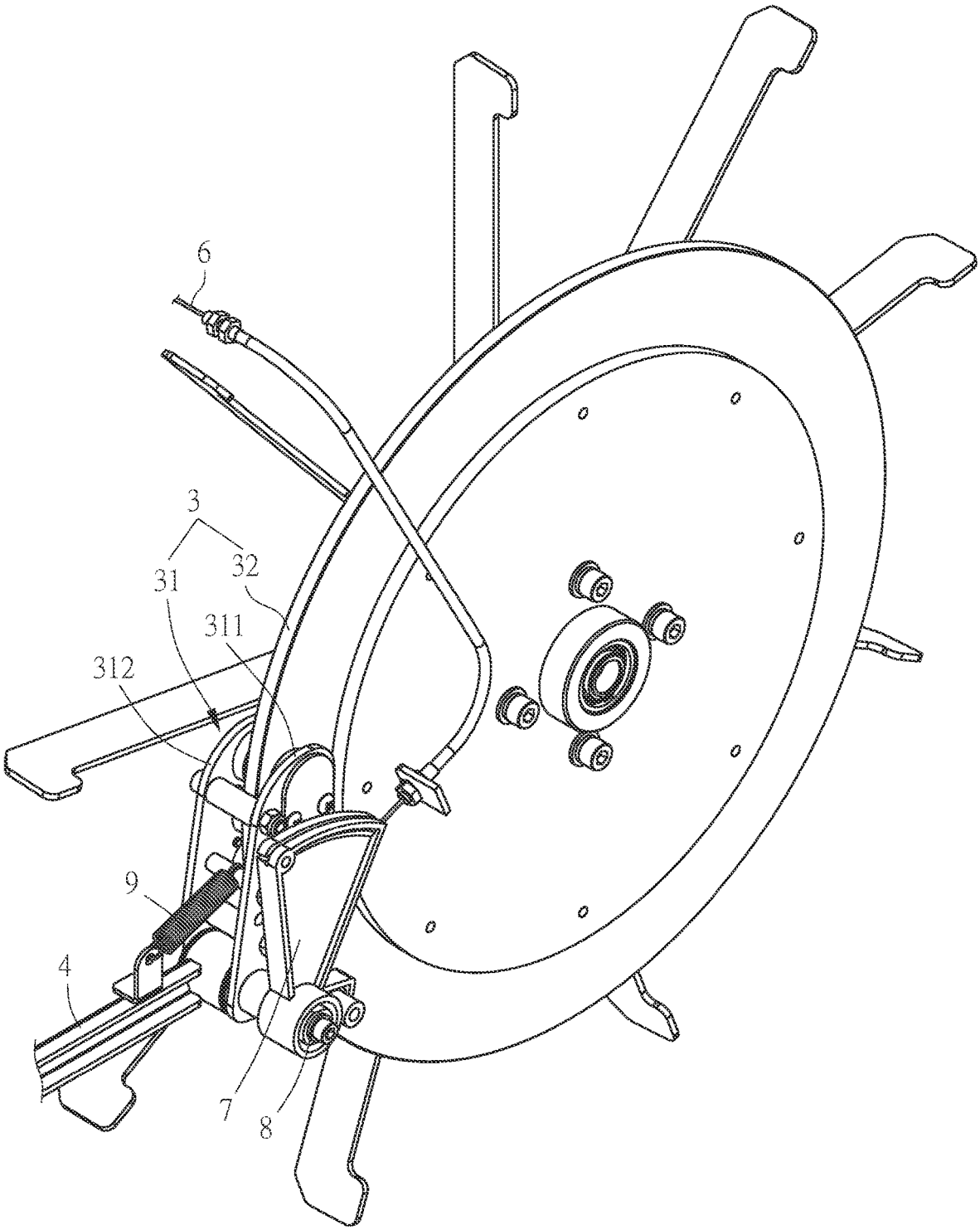
FIG. 5A is another perspective view of the dual resistance structure combining wind resistance and magnetic resistance of the present invention, illustrating the magnetic resistance unit is connected with the cable and the spring.
Figure 6:
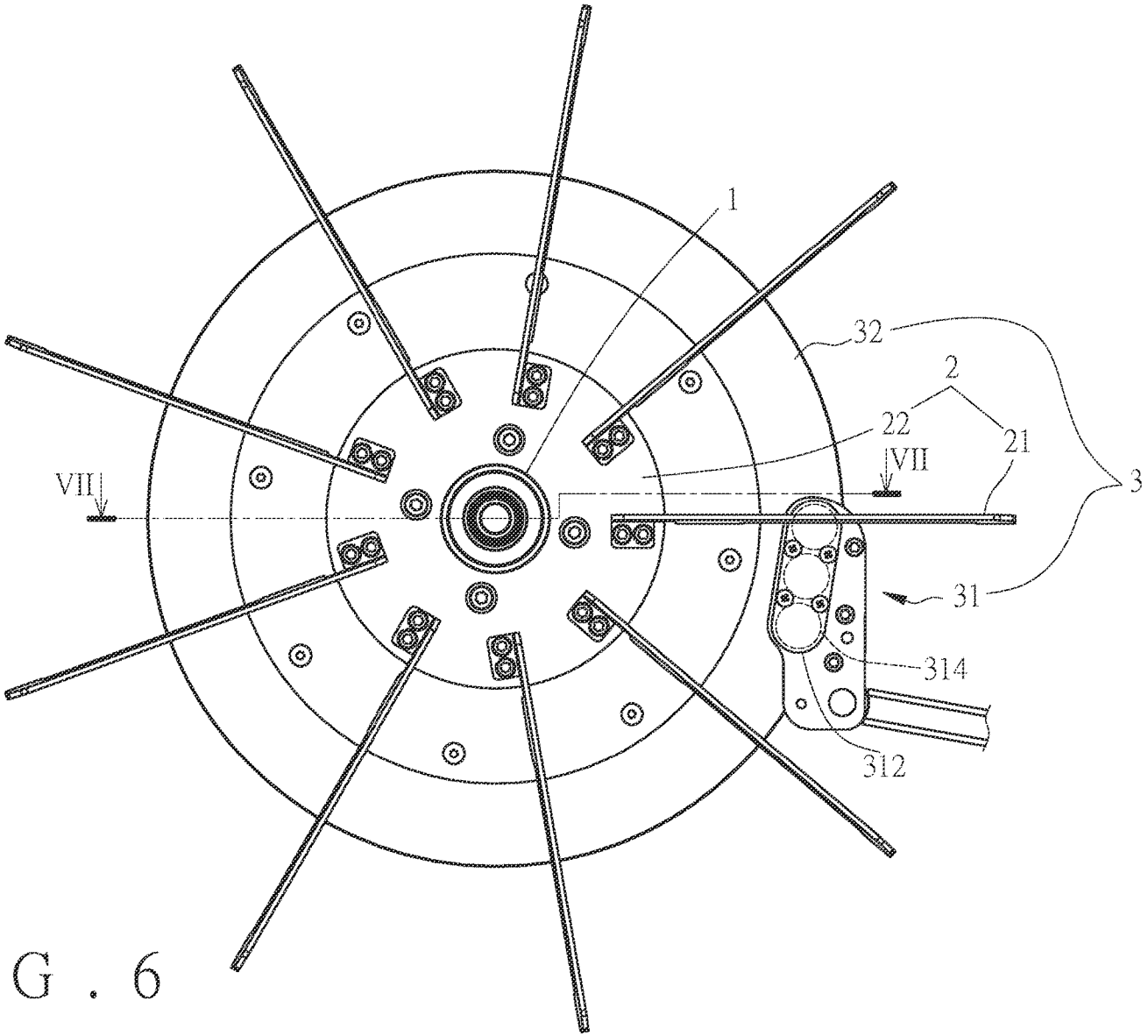
FIG. 6 is a side view of the dual resistance structure combining wind resistance and magnetic resistance of the present invention, illustrating that the magnetic resistance member is further moved into the moving space so that the entire magnetic member corresponds to the magnetic reluctance wheel.
Figure 7:
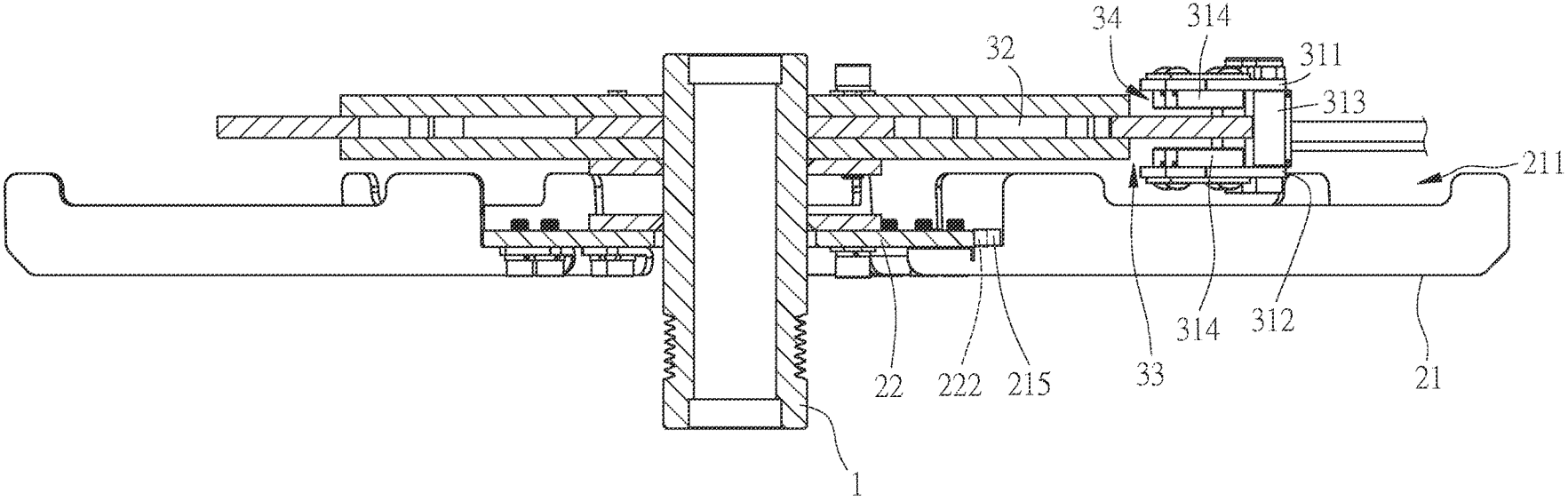
FIG. 7 is a cross-sectional view of the dual resistance structure combining wind resistance and magnetic resistance of the present invention, illustrating that the magnetic resistance member is further moved into the moving space so that the entire magnetic member corresponds to the magnetic resistance wheel.

Please refer to FIG. 5A, FIG. 6 and FIG. 7. When it is necessary to increase the magnetic resistance, the magnetic resistance member 31 is pulled by the cable 6, and the magnetic resistance member 31 is moved in the radial direction Y (as shown in FIG. 1) toward the magnetic resistance wheel 32. At this time, the second portion 312 of the magnetic resistance member 31 is still movable in the moving space 33 freely. In the state shown in FIG. 6 and FIG. 7, all the magnetic members 314 are moved into the area where the magnetic resistance wheel 32 is located. At this time, the magnetic resistance of the magnetic resistance wheel 32 is larger. When it is necessary to reduce the magnetic resistance, the cable 6 can be released, so that the spring 9 pulls the magnetic resistance member 31 and the driving block 7 away from the magnetic resistance wheel 32 synchronously, and part of the magnetic member 314 leaves the area where the magnetic resistance wheel 32 is located to reduce the magnetic resistance.

Referring to FIG. 4, when the user exercises on the exercise machine body 4, he/she can step on the operating portion 41 of exercise machine body 4 to rotate the rotating shaft 1 for doing exercise. The operating portion 41 transmits power to the wind resistance unit 2, so that the wind resistance unit 2 is rotated to generate wind resistance. When the user intends to increase the exercise intensity, the control unit 5 controls the magnetic resistance unit 3 to operate in the above-mentioned manner to adjust the magnitude of the magnetic resistance for increasing the exercise intensity.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual resistance structure combining wind resistance and magnetic resistance, comprising:

a rotating shaft;

a first mounting plate and a second mounting plate affixed to said rotating shaft in axially-spaced relationship between the first and second mounting plates;

a wind resistance unit disposed on the rotating shaft, the wind resistance unit including a turning disc fixed to said first mounting plate and a plurality of blades attached annularly to said turning disc, each blade of the plurality of blades having a free end, a coupling end opposite to said free end, a notch recessed in said each blade in an axial direction of the rotating shaft between said free and coupling ends, and an intermediate portion disposed between said notch and the coupling end, wherein a width of said each blade at said free end and said intermediate portion exceeds a width of the blade at said notch and at said coupling end, and wherein a peripheral edge of the turning disc is configured with a plurality of engaging grooves each recessed in the radial direction, said coupling end of said each blade being coupled in a respective one of said plurality of engaging grooves; and a magnetic resistance unit including a magnetic resistance member and a magnetic resistance wheel, the magnetic resistance wheel being disposed on the rotating shaft and attached to said second mounting plate, the notch of each of the blades facing the magnetic resistance wheel to form a moving space defined between the magnetic resistance wheel and said each blade at the notch, wherein when the magnetic resistance member is moved relative to the magnetic resistance wheel along a radial direction of the magnetic resistance wheel, part of the magnetic resistance member is movable in the moving space defined between the magnetic resistance wheel and said each blade at the notch.

2. The dual resistance structure combining wind resistance and magnetic resistance as claimed in claim 1, wherein the magnetic resistance member is located on a periphery of the magnetic resistance wheel, the magnetic resistance member includes a first portion, an opposing second portion and a connecting portion connecting the first portion and the second portion, a groove is defined among the first portion, the second portion and the connecting portion, the first portion or/and the second portion is provided with a magnetic member, and the second portion and the connecting portion are movable in the moving space when the groove is selectively moved in or out of the magnetic resistance wheel.

3. The dual resistance structure combining wind resistance and magnetic resistance as claimed in claim 1, wherein the turning disc has a diameter less than that of the magnetic resistance wheel, and said each blade extends in the radial direction beyond the magnetic resistance wheel.

4. The dual resistance structure combining wind resistance and magnetic resistance as claimed in claim 3, wherein the coupling end of said each blade has an L-shaped notch and a fixing piece extending from a periphery of the L-shaped notch, said each blade further has an engaging block extending in the radial direction, the fixing piece of said each blade is locked to the turning disc, and the engaging block is engaged in said respective engaging groove, thus fixing said each blade to the turning disc.

5. An exercise machine having a dual resistance structure combining wind resistance and magnetic resistance, comprising:

an exercise machine body, the exercise machine body having a control unit and an operating portion;

a rotating shaft, disposed on the exercise machine body and connected with the operating portion;

a first mounting plate and a second mounting plate affixed to said rotating shaft in axially-spaced relationship between the first and second mounting plates;

a wind resistance unit disposed on the rotating shaft, the wind resistance unit including a turning disc fixed to said first mounting plate and a plurality of blades attached annularly to said turning disc, each blade of the plurality of blades having a free end, a coupling end opposite to said free end, a notch recessed in said each blade in an axial direction of the rotating shaft between said free and coupling ends, and an intermediate portion disposed between said notch and the coupling end, wherein a width of said each blade at said free end and said intermediate portion exceeds a width of the blade at said notch and at said coupling end, and wherein a peripheral edge of the turning disc is configured with a plurality of engaging grooves each recessed in the radial direction, said coupling end of said each blade being coupled in a respective one of said plurality of engaging grooves; and a magnetic resistance unit including a magnetic resistance member and a magnetic resistance wheel, the magnetic resistance wheel being disposed on the rotating shaft and attached to said second mounting plate, the magnetic resistance member being pivotally connected to the exercise machine body and connected with the control unit, the notch of each of the blades facing the magnetic resistance wheel to form a moving space defined between the magnetic resistance wheel and said each blade at the notch, wherein when the magnetic resistance member is moved relative to the magnetic resistance wheel along a radial direction of the magnetic resistance wheel, part of the magnetic resistance member is movable in the moving space defined between the magnetic resistance wheel and said each blade at the notch.

6. The exercise machine as claimed in claim 5, wherein the magnetic resistance member is located on a periphery of the magnetic resistance wheel, the magnetic resistance member includes a first portion, an opposing second portion and a connecting portion connecting the first portion and the second portion, a groove is defined among the first portion, the second portion and the connecting portion, the first portion or/and the second portion is provided with a magnetic member, and the second portion and the connecting portion are movable in the moving space when the groove is selectively moved in or out of the magnetic resistance wheel.

7. The exercise machine as claimed in claim 5, wherein the turning disc has a diameter less than that of the magnetic resistance wheel, and said each blade extends in the radial direction beyond the magnetic resistance wheel.

8. The exercise machine as claimed in claim 7, wherein the coupling end has an L-shaped notch and a fixing piece extending from a periphery of the L-shaped notch, said each blade further has an engaging block extending in the radial direction, the fixing piece of said each blade is locked to the turning disc, and the engaging block is engaged in said respective engaging groove, thus fixing said each blade to the turning disc.

* * * * *